US011117414B2

(12) United States Patent
Schmidegg et al.

(10) Patent No.: US 11,117,414 B2
(45) Date of Patent: Sep. 14, 2021

(54) SECURITY ELEMENT AND VALUE DOCUMENT HAVING THIS SECURITY ELEMENT

(71) Applicants: Hueck Folien Gesellschaft M.B.H., Baumgartenberg (AT); Banque de France, Paris (FR)

(72) Inventors: Klaus Schmidegg, Gleisdorf (AT); Sonja Landertshamer, Linz (AT); Fabrice Capiez, Ceyrat (FR); Olivier Martin, Chamalières (FR); Roger Vilcot, Pérignat-lès-Sarliève (FR); Michel Blanc, Aubière (FR)

(73) Assignees: Hueck Folien Gesellschaft M.B.H., Baumgartenberg (AT); Banque de France, Paris (FR)

( * ) Notice: Subject to any disclaimer, the term of this patent is extended or adjusted under 35 U.S.C. 154(b) by 0 days.

(21) Appl. No.: 16/339,351

(22) PCT Filed: Oct. 4, 2017

(86) PCT No.: PCT/EP2017/075264
§ 371 (c)(1),
(2) Date: Apr. 3, 2019

(87) PCT Pub. No.: WO2018/065496
PCT Pub. Date: Apr. 12, 2018

(65) Prior Publication Data

US 2020/0047538 A1 Feb. 13, 2020

(30) Foreign Application Priority Data

Oct. 4, 2016 (EP) ..... 16192287

(51) Int. Cl.
*B42D 25/387* (2014.01)
*B42D 25/355* (2014.01)
(Continued)

(52) U.S. Cl.
CPC ..... *B42D 25/387* (2014.10); *B42D 25/355* (2014.10); *B42D 25/21* (2014.10); *B42D 25/328* (2014.10)

(58) Field of Classification Search
CPC .. B42D 25/387; B42D 25/355; B42D 25/328; B42D 25/21
(Continued)

(56) References Cited

U.S. PATENT DOCUMENTS

2002/0018430 A1* 2/2002 Heckenkamp ..... B44C 1/1716 369/109.01
2012/0031978 A1* 2/2012 Hansen ..... B42D 25/00 283/74

FOREIGN PATENT DOCUMENTS

EP 1241022 A1 9/2002
WO 2015095976 A1 7/2015

* cited by examiner

*Primary Examiner* — Justin V Lewis

(57) ABSTRACT

A security element and a value document having such a security element in the form of a strip having a first and second polymer layer are shown, having a visually recognizable halftone printed image, which is luminescent under UV radiation, between the first and second layer, wherein the halftone printed image has an opacity and forms at least one imprint area having a boundary contour within the security element. To increase the forgery protection, it is proposed that at least one of the two polymer layers have an opacity at least in the region of the boundary contour of the imprint area and be adapted in its opacity to the opacity of the imprint area, in order to diminish the visual recognizability of the boundary contour of the imprint area of the luminescent halftone printed image on the security element.

17 Claims, 3 Drawing Sheets

(51) Int. Cl.
*B42D 25/21* (2014.01)
*B42D 25/328* (2014.01)

(58) Field of Classification Search
USPC ..... 283/72, 74, 75, 94, 98, 901
See application file for complete search history.

SECURITY ELEMENT AND VALUE DOCUMENT HAVING THIS SECURITY ELEMENT

FIELD OF THE INVENTION

The invention relates to a value document and a security element in the form of a strip having a first and second polymer layer, and having a visually recognizable halftone printed image, which luminesces under UV radiation, between the first and second layer, wherein the halftone printed image has an opacity and forms at least one imprint area having a boundary contour within the security element.

BACKGROUND OF THE INVENTION

Security elements in the form of a strip are known from the prior art (EP 1 241 022 A1), which have an imprint, which luminesces under UV radiation, between a first polymer layer and a second polymer layer, which imprint is visually recognizable. Such a luminescent imprint always displays a certain opacity, however, so that the boundary contour of the imprint area on the security element is comparatively strongly recognizable. Such imprints can disadvantageously result in opacity differences on the security element and therefore impair the forgery protection, etc.

SUMMARY OF THE INVENTION

The invention therefore has the object, proceeding from the prior art described at the outset, of increasing the forgery protection of a security element having a luminescent imprint.

The invention achieves the stated object in that at least one of the two polymer layers has an opacity at least in the region of the boundary contour of the imprint area and is designed as adapted in its opacity to the opacity of the imprint area, to diminish the visual recognizability of the boundary contour of the imprint area of the luminescent halftone printed image on the security element.

If at least one of the two polymer layers has an opacity in the region of the boundary contour of the imprint area, in particular over the entire area, and is designed as adapted in its opacity to the opacity of the imprint area, to diminish the visual recognizability of the boundary contour of the imprint area of the luminescent halftone printed image on the security element, a security feature which is forgery-proof to a high degree can be provided on the security element—not least as a result of the increased production expenditure. Furthermore, it is possible in this manner to provide a security element having a concealed security feature, which security feature does not change the general appearance of the security element under specific conditions. This is because, according to the invention, the boundary contour of this luminescent imprint can be diminished and/or concealed in relation to the security element such that the visual recognizability of the imprint, in particular under white light, is not possible or is hardly possible—but it is easily visually recognizable very well under irradiation using UV light, for example. In contrast to the prior art, in which a visually easily recognizable imprint can already provide an indication with regard to a security feature as a result of not providing adaptation of the opacity, a security feature—which is not recognizable or is recognizable with difficulty under specific conditions, above all in white light—causes less attention in the security element according to the invention, which can in turn substantially contribute to improving a proof of the authenticity and, as a further consequence, the forgery protection.

In general, it is to be noted that a halftone printed image can be understood as a printed image having a printed grid, in which the grid points or printed points can be plotted adjacent to one another and one above another. An image effect can be created by additive color mixing and/or intensity variation. Halftone printed images can represent single-color or multicolor images.

In general, it is furthermore to be noted that for example, for this imprint which luminesces under UV radiation, a printing ink can be used which contains luminescent colorants or pigments. Such a luminescent colorant and/or luminescent pigment can be brought into an energetically excited state, for example, under the effect of radiation, and can then pass spontaneously into a state of lower energy, wherein photons of a specific wavelength are emitted, which is perceivable by the human eye in the case of a corresponding wavelength.

In general, it is furthermore to be noted that the luminescent imprint and/or the halftone printed image can be applied using any common printing method, for example, a contact or contact-free printing method, for example, gravure printing, screen printing, pad printing, offset printing, lithographic printing, flexographic printing, relief printing, or inkjet printing methods, etc.

In general, it is moreover noted that the opacity of the polymer layers is understood as being opaque to light in the wavelength range of visible light.

If the opacity values of the halftone printed image and at least one of the polymer layers are essentially equal, a stable and particularly simple and cost-effective visual concealment of the boundary contour of the luminescent imprint can be achieved. If the opacity values of the halftone printed image and the second polymer layers are essentially equal, and/or are adapted to one another in particular, it can be ensured in a simple manner that the advantages according to the invention are also achieved in the regions in which no halftone printed image is arranged above the second layer.

The visual recognizability of the boundary contour of the imprint area of the luminescent halftone printed image on the security element can be diminished particularly reliably if a diffusely scattering lacquer layer forms the first layer. A matte lacquer layer can be distinguished in this regard in particular. This is because such a diffusely scattering lacquer layer can stably compensate for different opacities on the security element, and therefore ensure a desired—above all homogeneous—appearance of the safety element. A particularly forgery-proof security element is to be provided in this manner.

In general, it is additionally to be noted that the security element can particularly advantageously be embedded in a value document if the first layer is printable. Alternatively, it is also possible to adapt the first layer and the value document optically and/or haptically to one another. The forgery protection of the security element can be improved by a full-area printability.

If the second layer is formed as an adhesive layer, the security element can thus be protected from external influences and at the same time it can be provided in a handling-friendly manner on a value document or on any arbitrary carrier. In particular, oxidation of the fluorescent colorant of the luminescent imprint can thus be avoided. According to the invention, a particularly robust and stable security element can be provided in this manner.

The adhesive layer can have in particular a hot-seal adhesive or a cold-seal adhesive. The second layer can alternatively also have a self-adhesive coating, a radiation-curing coating, or other comparable coatings, however.

In general, it is to be noted that the second layer can additionally be translucent. In this case, a particularly handling-friendly and also stable security element can be provided, since the second layer does not impair the visual appearance of the security element and therefore the security features thereof.

If the halftone printed image has grid points which luminesce in different colors, a multicolor luminescent imprint can be provided in a structurally simple manner. This multicolored luminescent imprint can even be designed as true color, if red and/or green and/or blue luminescent grid points are used.

A particularly forgery-proof security feature on the luminescent imprint can be provided if the halftone printed image has a honeycomb grid.

If the honeycomb grid has hexagonal grid cells, which consist of triangular grid points arranged adjacent to one another, the forgery protection of the security feature can be further improved—in particular if the grid points adjoin one another.

If each grid cell has two luminescent grid points of the same color in each case, the luminescent intensity and the color reproduction of the luminescent imprint can be made particularly homogeneous.

If the color impression of the grid cell is formed as a function of absent grid points, the variation of the color reproduction and the luminescent intensity within the halftone printed image can be achieved in a structurally simple manner.

In addition, the security element can be distinguished if the color impression of the grid cell is formed as a function of the size of the grid points. A particularly homogeneous halftone printed image can thus be provided, inter alia, which in turn can contribute to the forgery protection of the security element.

The grid points of the halftone printed image preferably have a size of 10 to 500 μm, in particular of 50 to 200 μm.

In general, it is to be noted that the forgery protection of the security element is further improvable if an embossed diffraction structure and a metallization adjoining this diffraction structure are provided between first and second layers. The embossed diffraction structure can interact in particular with the adjoining metallization in this case, to form a reflection hologram.

In general, it is to be noted that such a reflection hologram can optionally be attached in the observation direction above or below the luminescent imprint. If the reflection hologram is provided above the imprint, the visual recognizability of the imprint thus has to be ensured by corresponding openings in the reflection hologram.

In general, it is furthermore to be noted that the forgery protection of the security element can be further increased if it has machine-readable security features, in particular having magnetic properties, for example, in the form of a magnetic strip. It is also conceivable that such magnetic properties are provided in combination with a hologram.

In general, it is additionally to be noted that a particularly high level of stability and forgery protection of the security element can be achieved if the security element has a thickness of less than or equal to 30 μm, in particular less than or equal to 25 μm. Nearly protrusion-free embedding of the security element in a substrate or value document is thus possible.

The security element according to the invention can provide its advantages in particular if it is provided on a substrate of a value document—i.e., is connected thereto. For example, a banknote, a tax stamp, a passport, driver license, or personal identification, etc., are conceivable as a value document.

Above all, value documents can be distinguished in this regard which have a security element according to the invention, which extends continuously from one edge of the substrate to the opposite edge of the substrate. In this case, these can be security elements in the form of a strip, thread, or tape.

The forgery protection of the value document can be further improved if the surfaces of the first layer of the security element and the value document are essentially identical in the haptic properties and/or individual appearance thereof. Therefore, for example, as a further consequence, a visually recognizable opacity difference between substrate and luminescent imprint can be avoided—which it can conceal in a stable manner in the value document upon observation under white light. With regard to such an opacity difference, a printable matte lacquer layer on the security element can be distinguished in particular.

BRIEF DESCRIPTION OF THE DRAWINGS

The subject matter of the invention is illustrated in greater detail in the figures as an example on the basis of an embodiment variant. In the figures.

DETAILED DESCRIPTION OF THE PREFERRED EMBODIMENTS

Figure 1:
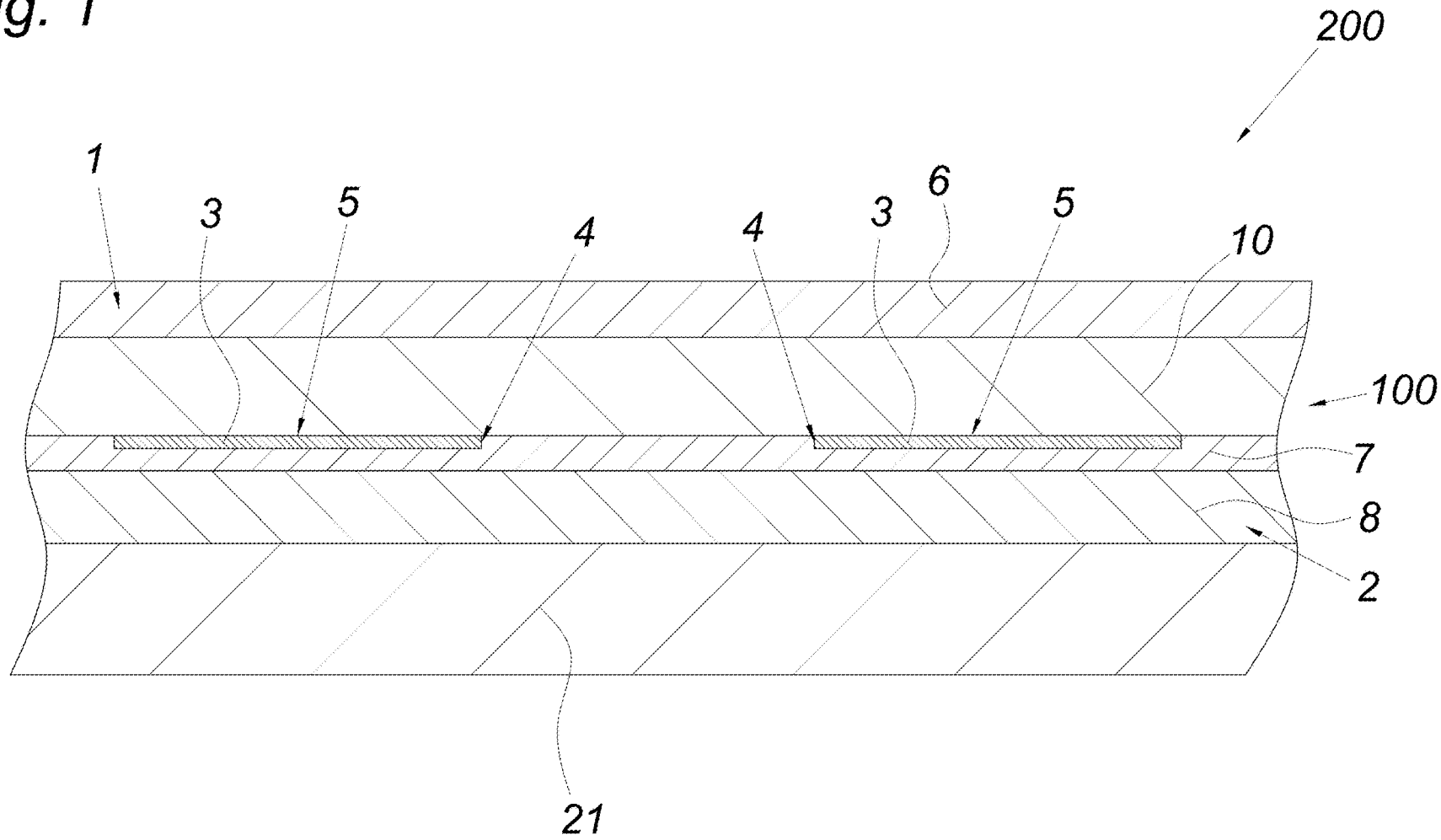
FIG. 1 shows a sectional view through a value document having a security element according to a first embodiment variant.

According to FIG. 1, a security element 100 is shown, which has a first polymer layer 1 and a second polymer layer 2, which are applied to a carrier substrate 10, in particular a carrier film. A halftone printed image 3, which has an opacity and is luminescent under UV radiation, is arranged between the first and second polymer layers 1, 2 on the carrier substrate 10, which forms at least one imprint area 5, which is delimited by a boundary contour 4, on the security element 100 as a security feature. The halftone printed image 3 is visually recognizable. The halftone printed image 3 can in this case in particular have a higher opacity in comparison to the unprinted region, or can be opaque.

According to the invention, the first polymer layer 1 and/or the second polymer layer 2 is/are preferably adapted in the opacity thereof to the opacity of the imprint area 5 in this case in regions of the boundary contour 4 of the imprint area 5, but particularly over the entire area, to thus diminish the visual recognizability of the boundary contour 4 of the imprint area 5. In the illustrated exemplary embodiment, the luminescent halftone printed image 3 is therefore concealed in the security element 100 upon observation under white light. The conditions under which the halftone printed image 3 are concealed or visible can be varied as needed, of course. Thus, in addition to increasing the design expenditure—and therefore more difficult simulation—forgery protection etc. are also increased by the security element 100 according to the invention.

It can be distinguished in particular if the first polymer layer 1 is formed by a diffusely scattering matte lacquer layer 6. This stably ensures the advantages according to the invention with regard to the boundary contour 4—but can also be distinguished in that it adapts the overall appearance of the security element 100 to that of the value document 200. Furthermore, the first layer 1, in particular in the form of the matte lacquer layer 6, is easily printable and can therefore be embedded in a particularly forgery-proof manner in a value document. The first layer 1 of the security element 100 is visually adapted in this case to the surface condition of the value document 200 or to the substrate 21 of the value document 200—which can also be planned with regard to the haptic properties.

In the example shown in FIG. 1, the second layer 2 is designed as a translucent hot seal lacquer layer 8. In addition, a protective lacquer 7 is applied over the hot seal lacquer 8, to protect the luminescent colorants contained in the halftone printed image 3 from oxidation. The opacity of the halftone printed image 3 and the second polymer layer 2 can alternatively be essentially equal, whereby the visual recognizability of the boundary contour 4 can be reduced particularly simply.

Figure 3:
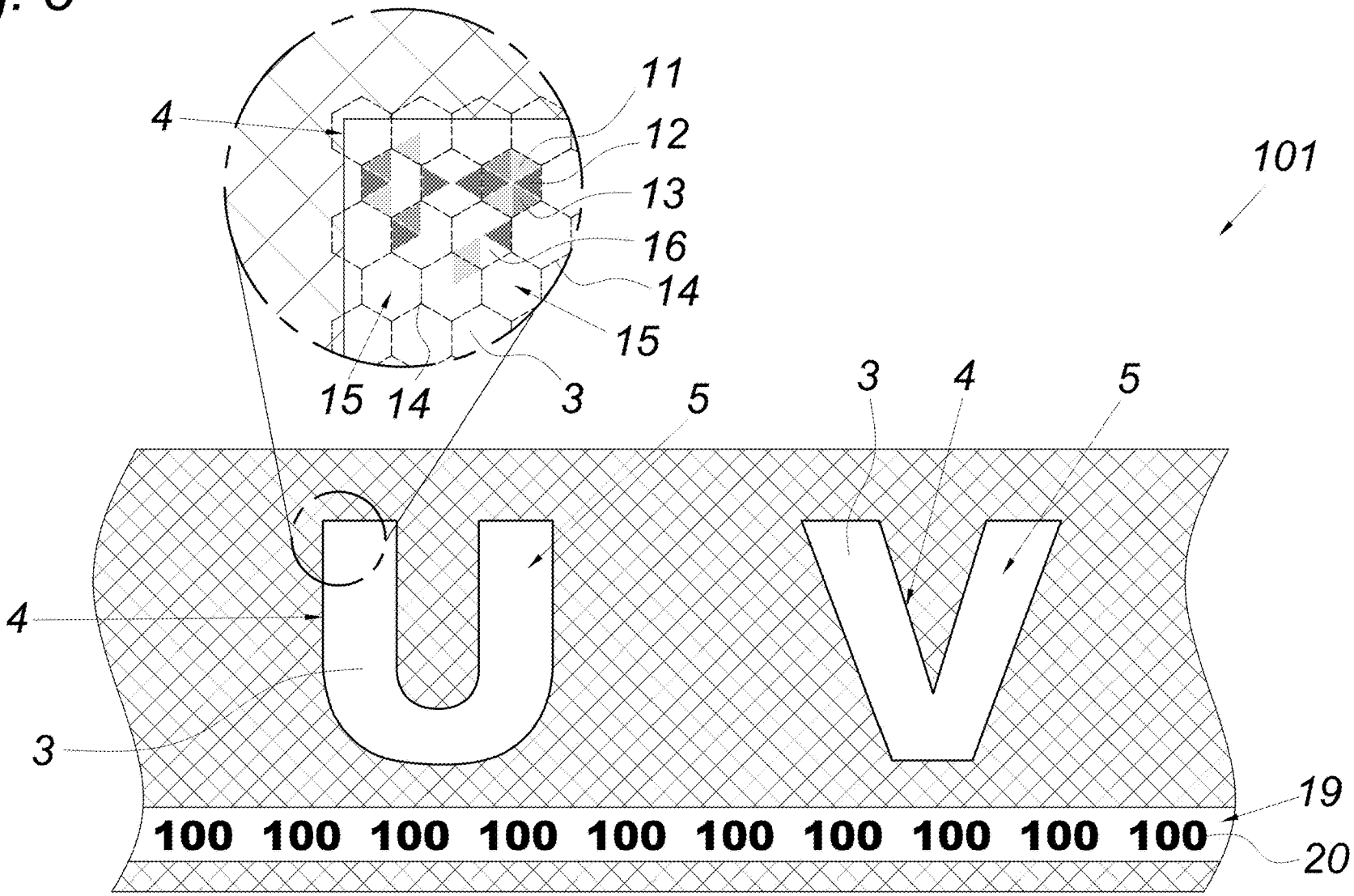
FIG. 3 shows a top view of the security element from FIG. 2.

The halftone printed image 3 of the security element 100 has, as can be seen in the top view in FIG. 3, red, green, and blue luminescent grid points 11, 12, and 13. A true-color luminescent halftone printed image 3 thus results. The grid points 11, 12, 13 are arranged in this case in a honeycomb grid 14 of the halftone printed image 3 such that each of the hexagonal grid cells 15 of the honeycomb grid 14 has six grid points 11, 12, 13, which are arranged adjacent to one another and adjoining one another. Each grid cell 15 displays in this case two red luminescent grid points 11, two green luminescent grid points 12, and two blue luminescent grid points 13. The different-colored grid points 11, 12, 13 are each arranged in alternating colors, and have a size of 10 to 500 μm, in particular 50 to 200 μm in this case.

To vary the color impression of a grid cell 15 and/or to create a true-color image, individual grid points 16 are omitted in the grid cell 15—as is shown in the detail portion in FIG. 3. It is also conceivable, but is not shown in greater detail in the figures, that the color impression of the grid cells 15 is formed via the varying size of the grid points 11, 12, 13.

Figure 2:
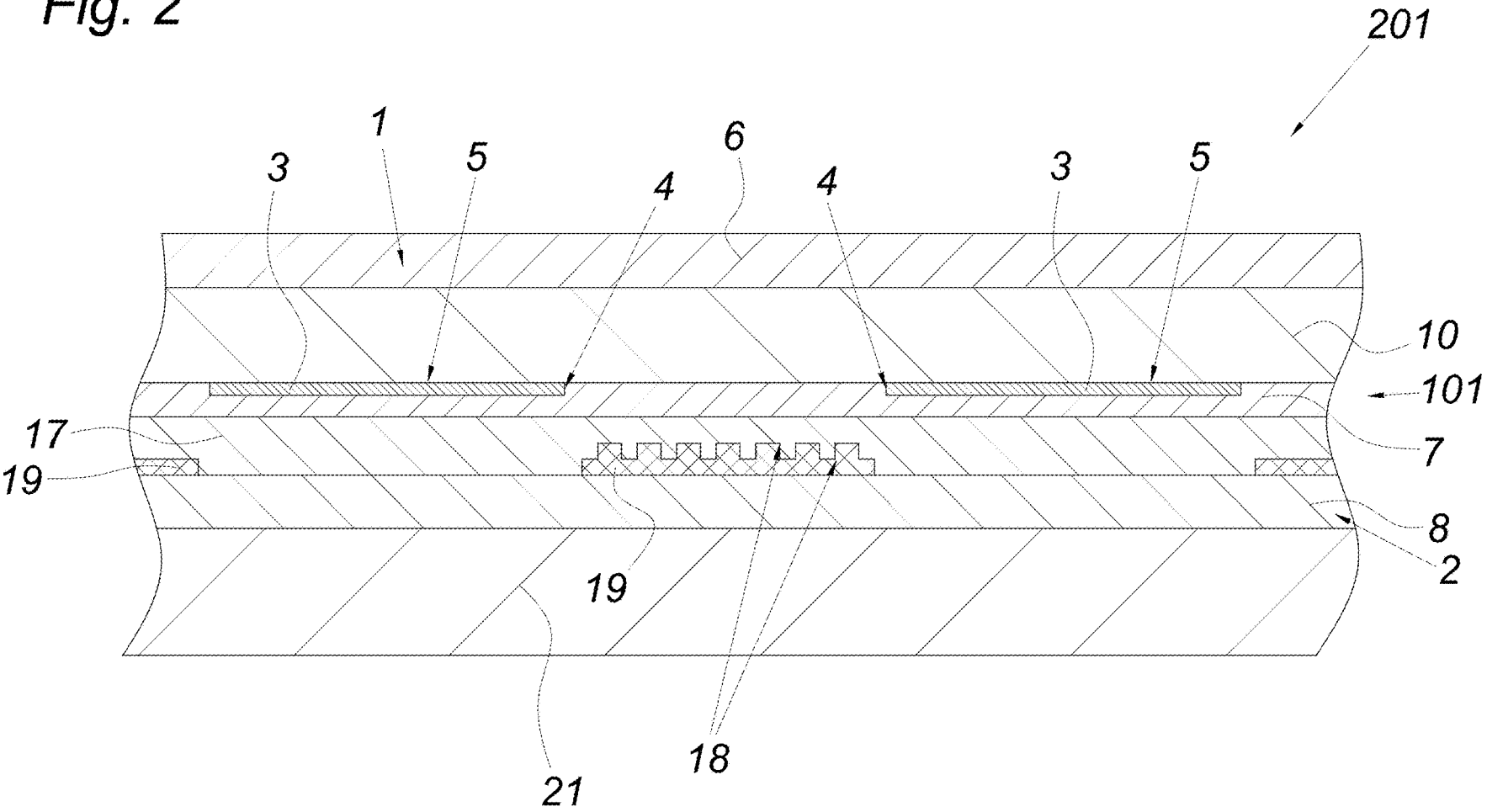
FIG. 2 shows a sectional view through a value document having a security element according to a second embodiment variant.

FIG. 2 shows a security element 101, wherein an embossing lacquer layer 17, which has an embossed diffraction structure 18, is provided between the first layer 1 and the second layer 2. In addition, a partial metallization 19 is applied as a reflection layer to the embossing lacquer layer 17, to interact with the embossed diffraction structure 18 to form a reflection hologram 20. The reflection hologram 20 can be partially provided in this case in the form of strips, characters, or patterns on the security element 101.

The security elements 100, 101 have a thickness of less than or equal to 30 μm, in particular less than or equal to 25 μm.

FIG. 1 and FIG. 2 show value documents 200, 201, wherein a security element 100 or 101 is applied in each case to the substrate 21 of the value document 200, 201, respectively. The value documents 200, 201 can be a banknote, a driver license, a personal identification, a passport, or a comparable item according to the invention.

The security elements 100, 101 can extend in this case continuously from one edge of the substrate to the opposite edge of the substrate 21, in particular in the form of a tape or a strip, which was not shown in greater detail in the figures, however.

The invention claimed is:

1. A security element in a form of a strip, comprising:

a first polymer layer;

a second polymer layer; and a visually recognizable halftone printed image, which luminesces under UV radiation, positioned between the first polymer layer and the second polymer layer, wherein the halftone printed image has a first opacity and forms at least one imprint area having the first opacity and a boundary contour within the security element, and wherein at least one of the first and second polymer layers has a second opacity at least in a region of the boundary contour of the imprint area that diminishes a visual recognizability of the boundary contour of the imprint area of the halftone printed image on the security element, and opacity values of the first opacity of the halftone printed image and the second opacity of at least one of the first and second polymer layers are essentially equal.

2. The security element according to claim 1, wherein the second opacity of at least one of the first and second polymer layers is present over an entire area of the imprint area having the first opacity.

3. The security element according to claim 1, wherein a diffusely scattering lacquer layer forms the first layer.

4. The security element according to claim 3, wherein the diffusely scattering lacquer layer is a matte lacquer layer.

5. The security element according to claim 1, wherein the second layer is formed as an adhesive layer.

6. The security element according to claim 1, wherein the halftone printed image has grid points which luminesce in different colors.

7. The security element according to claim 6, wherein the grid points of the halftone printed image have a size of 10 to 500 μm.

8. The security element according to claim 1, wherein the halftone printed image has a honeycomb grid.

9. The security element according to claim 8, wherein the honeycomb grid has hexagonal grid cells, which consist of triangular grid points, which are arranged adjacent to one another.

10. The security element according to claim 9, wherein each grid cell has two grid points which luminesce in a same color.

11. The security element according to claim 10, wherein a color impression of the halftone printed image is formed as a function of absent grid points.

12. The security element according to claim 10, wherein a color impression of the halftone printed image is formed as a function of a size of the grid points.

13. The security element according to claim 9, wherein the triangular grid points are arranged adjoining one another.

14. A value document having a substrate and having a security element according to claim 1, which is provided on the substrate.

15. The value document according to claim 14, wherein the security element extends continuously from one edge of the substrate to an opposite edge of the substrate.

16. The value document according to claim 14, wherein surfaces of the first layer of the security element and of the value document are essentially identical in haptic properties and/or in a visual appearance.

17. The security element according to claim 1, wherein opacity values of the first opacity of the halftone printed image and the second opacity of at least one of the first and second polymer layers are equal.

* * * * *